US008440963B2

(12) United States Patent
Belov

(10) Patent No.: US 8,440,963 B2
(45) Date of Patent: May 14, 2013

(54) SYSTEM AND PROCESS FOR PULSED MULTIPLE REACTION MONITORING

(75) Inventor: Mikhail E. Belov, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 326 days.

(21) Appl. No.: 12/871,685

(22) Filed: Aug. 30, 2010

(65) Prior Publication Data

US 2011/0248160 A1 Oct. 13, 2011

Related U.S. Application Data

(60) Provisional application No. 61/322,638, filed on Apr. 9, 2010.

(51) Int. Cl.
*H01J 49/42* (2006.01)

(52) U.S. Cl.
USPC ..... 250/283; 250/281; 250/282; 250/290; 250/292

(58) Field of Classification Search ..... 250/281, 250/282, 283, 290, 292
See application file for complete search history.

(56) References Cited

U.S. PATENT DOCUMENTS

| | | | | |
|---|---|---|---|---|
| 6,107,628 | A * | 8/2000 | Smith et al. | 250/292 |
| 6,753,523 | B1 | 6/2004 | Whitehouse et al. | |
| 2002/0185595 | A1* | 12/2002 | Smith et al. | 250/288 |
| 2002/0185606 | A1* | 12/2002 | Smith et al. | 250/423 R |
| 2004/0026611 | A1 | 2/2004 | Bateman et al. | |
| 2004/0183005 | A1* | 9/2004 | Hager | 250/282 |
| 2005/0006580 | A1* | 1/2005 | Hager | 250/292 |
| 2006/0124846 | A1 | 6/2006 | Covey et al. | |
| 2007/0138384 | A1* | 6/2007 | Keiser | 250/282 |
| 2009/0294647 | A1* | 12/2009 | Michelmann | 250/282 |
| 2009/0294662 | A1* | 12/2009 | Belov et al. | 250/291 |
| 2010/0108879 | A1* | 5/2010 | Bateman et al. | 250/283 |
| 2010/0176291 | A1* | 7/2010 | Hager et al. | 250/283 |
| 2010/0301201 | A1* | 12/2010 | Gordon et al. | 250/282 |

OTHER PUBLICATIONS

International Search Report/Written Opinion for International Application No. PCT/US2011/021009, International Filing Date Jan. 12, 2011.

Ibrahim, Y., et al, Ion Funnel Trap Interface for Orthogonal Time-of-Flight Mass Spectrometry, Analytical Chemistry, vol. 79, No. 20, Oct. 15, 2007.

Creaser. C. S., et al., A Tandem Ion Trap/Ion Mobility Spectrometer, Anal. Chem., 2000, 72, 2724-2729.

Eiceman, G. A., et al., Analysis of a drift tube at ambient pressure: Models and precise measurements in ion mobility spectrometry, Review of Scientific Instruments, 72, 9, Sep. 2001, A4-3621.

Gibbons, F. D., et al., Silver Helps Assign Peptides to Tandem Mass Spectra Using Intensity-Based Scoring, 2004 American Society for Mass Spectrometry, Published by Elsevier, Inc., Dec. 17, 2003, 910-912.

(Continued)

*Primary Examiner* — Michael Logie
(74) *Attorney, Agent, or Firm* — James D. Matheson

(57) ABSTRACT

A new pulsed multiple reaction monitoring process and system are disclosed that uses a pulsed ion injection mode for use in conjunction with triple-quadrupole instruments. The pulsed injection mode approach reduces background ion noise at the detector, increases amplitude of the ion signal, and includes a unity duty cycle that provides a significant sensitivity increase for reliable quantitation of proteins/peptides present at attomole levels in highly complex biological mixtures.

13 Claims, 12 Drawing Sheets

OTHER PUBLICATIONS

Hoaglund, C. S., et al., An Ion Trap Interface for ESI—Ion Mobility Experiments, Analytical Chemistry, 69, 20, Oct. 15, 1997, 4156-4161.

Ibrahim, Y., et al., Ion Funnel Trap Interface for Orthoganal Timo-of-Flight Mass Spectrometry, Anal. Chem., 2007, 79, 7845-7852.

Armbruster, D. A., et al., Limit of Detection (LOD)/Limit of Quantitation (LOQ): Comparison of the Empirical and the Statistical Methods Exemplified with GC-MS Assays of Abused Drugs, Clin. Chem., 40, 7, 1994, 1233-1239.

Tang, K., et al., High-Sensitivity Ion Mobility Spectrometry/Mass Spectrometry Using Electrodynamic Ion Funnel Interfaces, Anal. Chem., 77, 2005, 3330-3339.

Wyttenback, T., et al., Design of a new electrospray ion mobility mass spectometer, International Journal of Mass Spectrometry, 212, 2001, 13-23.

* cited by examiner

| Parent Ions | Ion | Trans. | Frag. | Trans. | Frag. | Trans. | Frag. | CE |
|---|---|---|---|---|---|---|---|---|
| Kemptide (SEQ. ID. NO. 1) | 386.74 (2+) | 409.27 | $b_3-NH_3$ | 539.34 | $a_5-NH_3$ | 567.33 | $b_5-NH_3$ | 25 |
| Angiotensin I (SEQ. ID. NO. 2) | 432.90 (3+) | 534.27 | $b_4$ | 619.36 | $a_5$ | 647.35 | $b_5$ | 21 |
| Syntide 2 (SEQ. ID. NO. 3) | 503.32 (3+) | 283.18 | $b_3$ | 429.28 | $y_4$ | 705.94 | $y_{14}^{2+}$ | 23 |
| Bradydinin (SEQ. ID. NO. 4) | 530.79 (2+) | 522.27 | $y_9^{2+}-NH_3$ | 710.36 | $y_6$ | 807.42 | $y_7$ | 30 |
| Dynorphin A Porcine 1-13 (SEQ. ID. NO. 5) | 535.34 (3+) | 455.21 | $y_{11}^{3+}-NH_3$ | 529.70 | $y_{13}^{3+}-NH_3$ | 712.68 | $y_12^{3+}-NH_3$ | 28 |
| Leucine Enkephalin (SEQ. ID. NO. 6) | 556.28 (+) | 278.11 | $b_3$ | 397.19 | $a_4$ | 425.18 | $b_4$ | 22 |
| Neurotensin (SEQ. ID. NO. 7) | 558.31 (3+) | 578.85 | $y_9^{2+}$ | 643.73 | $y_{10}^{2+}$ | 725.90 | $y_{11}^{2+}$ | 26 |
| Fibrinopeptide A (SEQ. ID. NO. 8) | 768.85 (2+) | 445.25 | $y_5$ | 645.33 | $y_7$ | 1077.53 | $y_{11}$ | 29 |

*Fig. 2*

SYSTEM AND PROCESS FOR PULSED MULTIPLE REACTION MONITORING

CROSS REFERENCE TO RELATED APPLICATION

This application claims priority from Provisional Application No. 61/322,638 filed 9 Apr. 2010, incorporated in its entirety herein.

STATEMENT REGARDING RIGHTS TO INVENTION MADE UNDER FEDERALLY-SPONSORED RESEARCH AND DEVELOPMENT

This invention was made with Government support under Contract DE-AC05-76RLO5640 awarded by the U.S. Department of Energy. The Government has certain rights in the invention.

FIELD OF THE INVENTION

The present invention relates to a system and process for pulsed multiple reaction monitoring in conjunction with quadrupole instruments for quantitative analysis of low abundance analytes in complex biochemical matrices.

BACKGROUND OF THE INVENTION

Liquid chromatography (LC)—tandem quadrupole mass spectrometry (MS/MS), or (LC-MS/MS), has been widely applied for protein, peptide, and metabolite quantitation in proteomics and metabolomics studies. Sensitivity is important for reliable detection and quantitation of low-abundance species in complex biological matrices. Recent developments including incorporation of an electrodynamic ion funnel (IF), an S-lens, or an RF only quadrupole ion guide as a front-end interface to a triple quadrupole MS instrument have improved ion sampling and ion transport from an ESI ion source to an MS detector resulting in an increase in LC-MS/MS sensitivity. However, the limit of detection (LOD) for current state-of-the-art instruments remains inadequate for reliable quantitation of low (e.g., ng/mL) quantities of biologically-significant proteins present in complex biological matrices in part due to elevated levels of chemical background typically observed in high throughput modes of operation at shorter LC gradients. Accordingly, new instrument developments are needed that provide the required sensitivity for reliable quantitation of biologically-significant proteins present at low quantities in complex biological matrices. The present invention meets these needs.

SUMMARY OF THE INVENTION

The present invention addresses these needs by providing a pulsed multiple reaction monitoring method characterized the steps of accumulating a preselected precursor ion in a trapping device at a pressure of at least about 1 Torr; and transmitting accumulated precursor ions as a compressed ion packet into a quadrupole while synchronized with the onset of an ion scan within the scanning quadrupole. In various embodiments the method may also include the steps of transmitting a second accumulated packet of preselected precursor ions through a first resolving quadrupole; and collisionally activating the selected accumulated packet in a collision cell to generate fragment ions. In other embodiments this process can be modified whereby the method comprises the steps of accumulating a preselected precursor ion over a preselected mass-to-charge (m/z) range in a radio frequency trapping device at a pressure of at least about 1 Torr; releasing the accumulated precursor ions as a compressed ion packet synchronized with the onset of the ion scan in a second resolving quadrupole (Q3); transmitting an accumulated packet of preselected precursor ions through a first resolving quadrupole (Q1) in a mass-to-charge (m/z) range less than the m/z range of the compressed ion packet released from the RF trapping device; collisionally activating the selected narrow precursor ion packet in a collision cell (Q2) to generate fragment ions (MS/MS transitions) for the selected precursor ion packet to form fragment ion signals of a desired intensity; and transmitting an ion packet for a selected fragment ion (transition) over a more narrow m/z range through the second resolving quadrupole (Q3).

In one application the invention includes a system for pulsed reaction monitoring in conjunction with a triple quadrupole instrument for analysis of low-abundance ions and ion fragments, the system including an ion funnel trap (IFT) interface coupled in front of a triple quadrupole instrument configured to discontinuously trap and accumulate ions from an ion source, release a compressed ion packet synchronously with the onset of a scan in a second resolving quadrupole (Q3), transmit compressed ion packets through a first resolving quadrupole (Q1) over a preselected narrow mass-to-charge (m/z) range, collisionally activate a selected (m/z) ion packet in a collision cell (Q2), and transmit an ion packet comprised of specific fragment ions (ion transitions) through a second resolving quadrupole (Q3) over a preselected mass-to-charge (m/z) range.

The present invention provides a new pulsed multiple reaction monitoring process and system are disclosed that uses a pulsed ion injection mode for use in conjunction with triple-quadrupole instruments. The pulsed injection mode approach reduces background ion noise at the detector, increases amplitude of the ion signal, and includes a unity duty cycle that provides a significant sensitivity increase for reliable quantitation of proteins/peptides present at attomole levels in highly complex biological mixtures.

The purpose of the foregoing abstract is to enable the United States Patent and Trademark Office and the public generally, especially scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Various advantages and novel features of the present invention are described herein and will be readily apparent to those skilled in this art from the following detailed description. In the preceding and following descriptions the preferred embodiment of the invention is shown and described by way of illustration of the best mode contemplated for carrying out the invention. As will be realized, the invention is capable of modification in various respects without departing from the invention. Accordingly, the drawings and description should be seen as illustrative of the invention and not as limiting in any way.

BRIEF DESCRIPTION OF THE DRAWINGS

FIG. 2 shows exemplary peptides and ion transitions tested in conjunction with the invention.

DETAILED DESCRIPTION

A pulsed multiple reaction monitoring (MRM) system and process are disclosed that provide quantitative and reliable analysis of low-abundance analytes in complex biological matrices. The invention enhances sensitivity by coupling an ion funnel trap (IFT) interface as a front-end to a triple quadrupole mass spectrometer instrument that deploys a pulsed ion beam. The invention provides the ability to select specific m/z precursor ions (Q1), isolate and fragment ions by collision-induced dissociation (Q2); and sequentially select and detect multiple, specific m/z fragment ions (transitions) (Q3). The pulsed MRM approach of the invention has a broad range of potential applications, including, e.g., proteomics, lipidomics, metabolomics, pharmakinetics, and other areas where, e.g., molecular sequence information is essential for reliable quantitative analysis of low abundance compounds. Life sciences, biotechnology and pharmaceutical industries can benefit strongly from the improved sensitivity and reproducibility of biosample analyses using the invention in concert with triple quadrupole instruments.

Figure 1A:
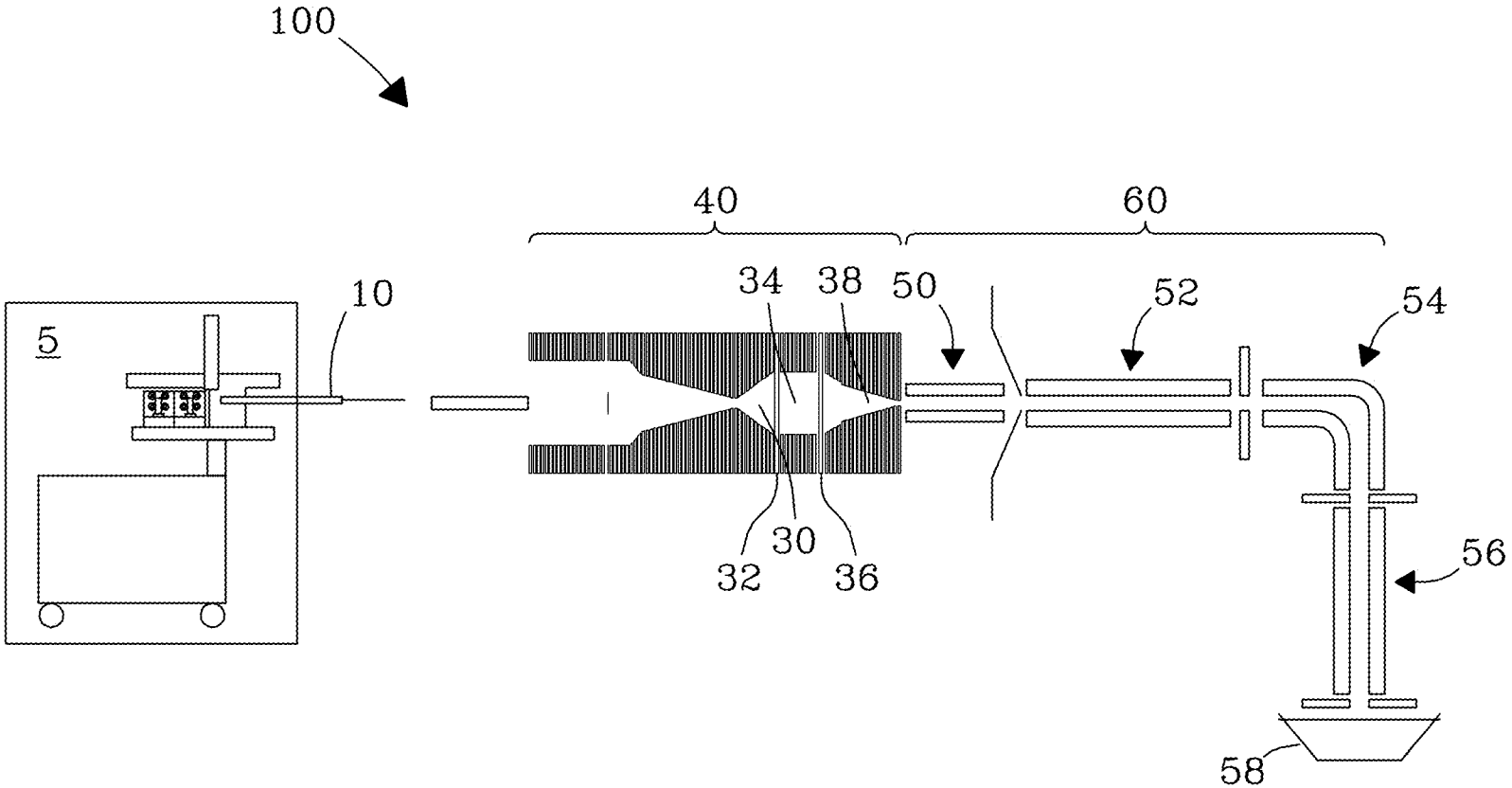
FIG. 1*a* shows an exemplary LC-MS/MS system used in conjunction with the invention.

FIG. 1*a* is a cross-sectional view of a triple quadrupole instrument system 100 (e.g., LC-MS/MS). Components described hereafter are exemplary, and not intended to be limiting. System 100 includes a high-performance liquid chromatography (HPLC) instrument 5 custom-built to include two microbore chromatographic columns (not shown) and an auto sampler (CTC Analytic, Switzerland) described by Belov et al. (*J. Am. Soc. Mass Spectrom.* 2004, 15, 212-232), which reference is incorporated herein. LC instrument 5 elutes and separates biopolymers (e.g., proteins) at a preferred and non-limiting flow rate of 100 nL/min in complex biological samples. LC instrument 5 is coupled to an ionization source 10 (e.g., ESI) that ionizes liquid samples after liquid chromatography (LC) separation. System 100 further includes an ion funnel trap (IFT) 40 as an interface that precedes a triple quadrupole mass spectrometer (MS) instrument 60. Triple quadrupole instrument 60 includes a modified front end. The heated inlet capillary-skimmer interface (not shown) of the commercial quadrupole instrument 60 is replaced with the ion funnel trap (IFT) 40 interface positioned between ionization source 10 and quadrupole instrument 60. IFT 40 is an RF device that operates at a pressure ≧1.0 torr. Construction and operation of IFT 40 is detailed, e.g., by Ibrahim et al. (*Anal. Chem.* 5807, 79, 7845) and Belov et al. in U.S. patent application Ser. No. 12/156,360 filed 30 May 2008, now published as U.S. Publication Number 2009-0294662 published on 3 Dec. 2009, which references are incorporated herein. IFT 40 accumulates and traps precursor ions in subsequent ion accumulation and ion release cycles in conjunction with ion gating functions using an entrance grid (ring electrode) 32 and an exit grid 36 described further herein in reference to timing for pulsed MRM mode operation. Inlet portion 30 of ion funnel trap (IFT) 40 includes a diverging geometry that maximizes expansion of the ion plume introduced to trapping portion 34 through entrance grid 32. Trapping portion 34 traps, accumulates, and compresses selected precursor ions within IFT 40. Trapping portion 34 releases ions to outlet portion 38 through exit grid 36. Outlet portion 38 includes a converging geometry that focuses ions released from trapping portion 34. In the exemplary embodiment, MS instrument 60 of system 100 is a TSQ Quantum Ultra Triple Stage Quadrupole Mass Spectrometer (Thermo Fisher Scientific, San Jose, Calif.) equipped with a mass-selective detector 58. Mass spectrometer 60 includes a first resolving quadrupole (Q1) 52 that selects specific m/z precursor ions. A second quadrupole stage (Q2) 54 with a quadrupole collision cell 54 isolates and fragments (collisionally activates) precursor ions by collision-induced dissociation. A third resolving quadrupole (Q3) 56 sequentially selects, separates, and resolves specific m/z fragment ions (transitions) by their mass-to-charge ratios. Transitions are detected in conjunction with detector 58. Mass spectrometer 60 includes an additional separation step beyond the initial LC/MS for analytes requiring further separation, permitting tandem MS/MS analyses. Detection and counting of selected ions processed by either MS produces mass chromatograms of ion count versus time.

The system 100 is operated in a pulsed Multiple Reaction Monitoring (MRM) mode in conjunction with IFT 40 positioned in front of triple quadrupole MS instrument 60, which requires different ion selection and detection. Pulsed MRM is the process whereby RF/DC parameters within the Q3 quadrupole 56 are optimized for transition peaks of interest when selected ion fragment packets arrive at Q3 quadrupole 56. Optimization of RF/DC parameters serves to center and maximize signal peaks for fragment ions (transitions) within a very narrow m/z (e.g., 1 mDa to 2 mDa) or timescale (~10 msec) range within the Q3 ion scan. Transitions correspond to precursors previously resolved within the Q1 quadrupole 52 within a narrow range (e.g., 1-2 Da). The pulsed MRM approach of the invention increases sensitivity compared to conventional continuous mode processes. In particular, LC-IFT-pulsed MRM approach reduces chemical background, increases MS signal amplitude, and provides a unity duty cycle. "Duty cycle" as used herein refers to the ratio of active analysis time to time in a standby mode. The increase in duty cycle provided by the invention yields short MRM dwell times, providing acquisition periods that are comparable to, or shorter than, the dead time 112 between transitions described hereafter. "Dead time" refers to the switching time between two analytical transitions.

Figure 1B:
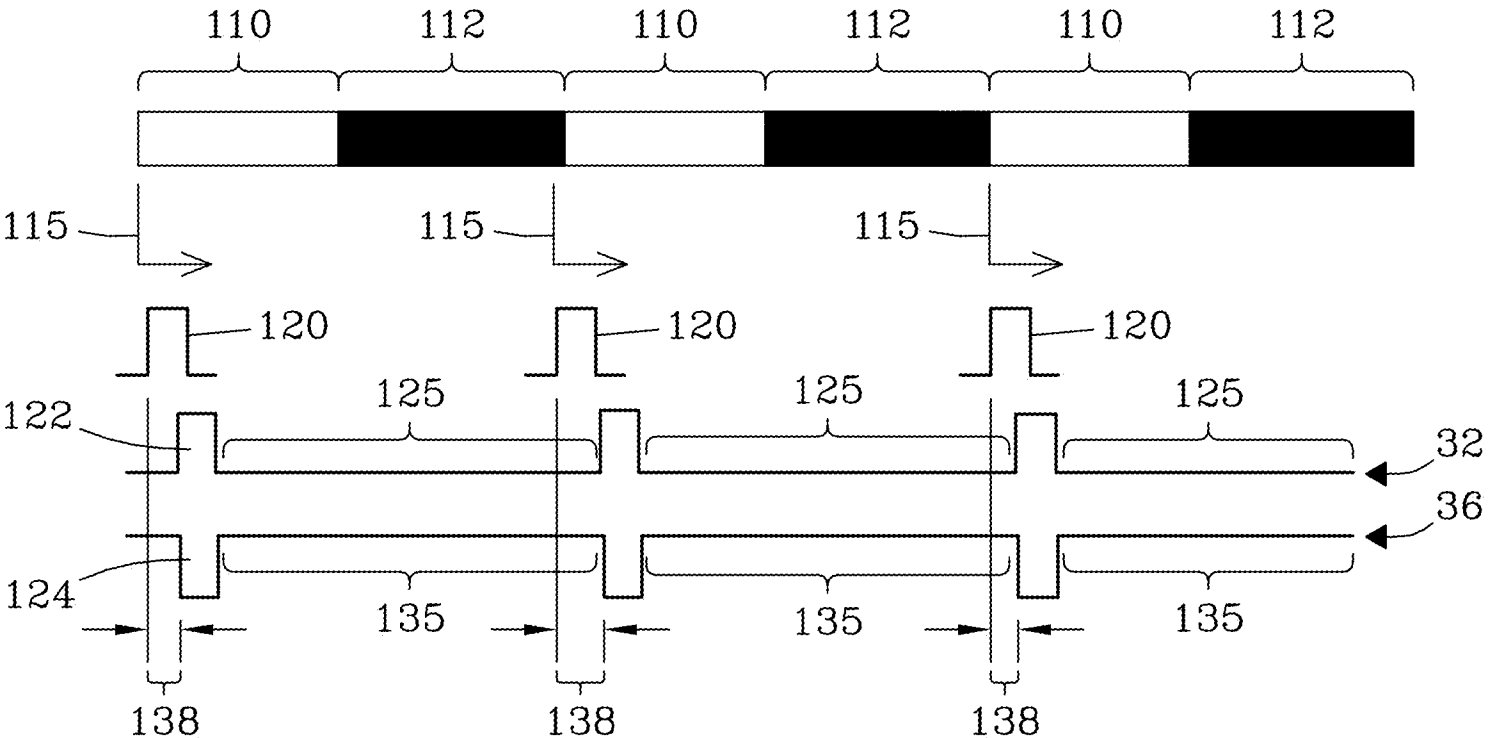
FIG. 1*b* shows an exemplary timing diagram for pulsed MRM mode operation.

FIG. 1*b* shows an exemplary timing diagram that synchronizes operation of the ion funnel trap (IFT) (FIG. 1*a*) with the triple quadrupole instrument (FIG. 1*a*) described previously herein. In particular, operation of the IFT in pulsed MRM mode requires synchronization between an ion release event 125 (i.e., ejection) from the IFT and the ion scan event in the Q3 quadrupole. During pulsed MRM analysis, a spatially compressed ion packet is injected into the triple quadrupole analyzer during a short (~300 μs) release event (ejection). In the figure, a Q3 trigger pulse 120 is delivered at the start 115 of each new transition 110. Following trigger pulse 120, the potential of entrance grid 32 increases as the potential of exit grid 36 decreases resulting in ion ejection from the trap in the release event 125. Thereafter, the potential of entrance grid 32 decreases opening the entrance grid for the incoming ions from the source as the potential of exit grid 36 increases to enable ion trapping for the following accumulation event. A period of ion accumulation 135 follows in the IFT. The interval between the rising edge of the Q3 trigger pulse 120 and the rising (falling) edge at the entrance (exit) grid pulse (122, 124) introduces a short delay period 138 described further herein. Dead time 112 between the end of one transition 110 and start 115 of another transition 110 in the Q3 quadrupole (FIG. 1*a*) is practically eliminated by the pulsed MRM mode of the invention 112. The first resolving quadrupole (Q1) transmits ion packet ions in a narrow m/z range (~1 Da) corresponding to precursor ions of interest. Following fragmentation in collision cell (Q2), a narrow (<5 msec) packet of transition (fragment) 110 ions enter second resolving quadrupole (Q3). The Q3 transmits specific fragment ions (selected transitions) over a narrow m/z window (~2 mDa) over a short dwell time 138 from about 2 ms to about 40 ms. Thus, the ion release event 125 from the IFT is delayed with respect to the start of the Q3 ion scan by a delay time 138. The delay 138 accounts for the transit time of the ion packet from the exit grid of the IFT to the entrance of the Q3 quadrupole. A preferred delay time 138 yields an arrival time of (fragment) ion packets in the middle of the Q3 ion scan, such that the signal peak amplitude is acquired at the optimum RF/DC settings for a given transition in the Q3 quadrupole. Temporal profiles of a precursor and the corresponding fragment ions are similar as the precursor ion mass is significantly larger than that of the collision gas, resulting in a minor change in the velocity vector of the precursor ions upon collision. Because the temporal profile for ion packet i.e., both precursor and fragment ions) is shorter (<5 msec) than the duration of ion scan (>10 msec) in the Q3 quadrupole, all transmitted ions in the ion packet yield a narrow peak positioned at the middle (center) of the ion scan in the Q3 quadrupole, despite the m/z width of the ion scan in the Q3 quadrupole. For example, given a scan duration of ~10 msec and a Q3 m/z selection window (m/z width) of ~2 mDa, pulsed MRM operation yields a narrow peak at the center (i.e., middle) of the m/z range. Additionally, traverse time for the ion packet across the Q3 quadrupole is shorter than the time (or averaging time) of ion scan. This difference accounts for the narrow lineshape of the signal peak observed at the detector (FIG. 1*a*). Another advantage of the pulsed MRM approach is the independence of the delay time 138 on the m/z for a specific transition. Therefore, the time interval between release (eject) 125 of the ion packet from the exit gate (FIG. 1*a*) of the IFT in conjunction with ion trigger (release) pulse 120 and the arrival of the ion packet at the entrance of the Q3 quadrupole is similar for different precursor ions and only a single delay time 138 need be used for all transitions 110 selected for LC-MRM studies. This advantage drastically simplifies experimental setup and makes the pulsed MRM approach suitable for analysis of an arbitrary number of transitions 110. Synchronization (trigger) pulse 120 is fed from MS (TSQ) instrument 60 into a digital input/output card (e.g., an USB-6221 input/output card, National Instruments, Austin, Tex., USA) (not shown) to trigger a digital waveform. The digital waveform is supplied as an input to a custom-built voltage amplifier (not shown) equipped with two independent channels used to control entrance gate (grid) 32 and exit gate (grid) 36 of the IFT.

The pulsed MRM process of the invention provides several advantages over the continuous mode of operation employed in the conventional MRM approach. The IFT interface provides efficient ion confinement and ejection at pressures of from about 1 torr to about 5 torr. And, since trapping efficiency in the IFT is proportional to the number density of gas molecules, accumulation of ions at elevated pressures in the IFT is orders of magnitude more efficient than other conventional ion traps (e.g., 3-D quadrupolar ion trap). Following accumulation, the IFT ejects ions as discrete, high density (compared to the charge density in continuous mode) donut-shaped packets and confines them to a smaller radius in the converging section (FIG. 1*a*) of the IFT (e.g., reduced from a 20 mm radius in trapping portion (FIG. 1*a*) to a 2 mm radius in the converging section). This confinement in the converging section occurs without ion losses because the ion cloud separates according to the ion mobilities, resulting in a reduced Coulombic repulsion at any plane perpendicular to the axis of the trap. The IFT interface provides additional advantages, including: a high trapping efficiency (≧50%), a high charge capacity (≧$3\times10^7$ elementary charges), and a high duty cycle (≧95%), described in more detail hereafter. The term "duty cycle" refers to the ratio of active analysis time to time in a standby mode. Main advantages of the pulsed MRM approach can be summarized as follows. First, ion accumulation in the IFT device is RE-field assisted. Not only RF field radially confines ions at the high operating pressures (e.g., 1 torr or greater) but also facilitates auxiliary RF-heating that improves droplet desolvation. This manifests as a reduced chemical background (i.e., ion noise) at the detector (FIG. 1*a*). Second, pulsed MRM of the invention increases signal amplitude for a given MS peak due to an order-of-magnitude increase in the ion charge density (due to ion accumulation in the IFT) per unit time compared to the continuous mode, which improves the Limit of Detection (LOD) at the detector. And third, pulsed MRM in concert with the IFT eliminates dead times between transitions, which permits a unity duty cycle in signal detection to be obtained, providing enhanced signal detection and improved signal-to-noise ratio. Continuous ion streams produce a duty cycle on the order of about 60% (e.g., a 10 msec scan time and a 4 msec delay period yields a duty cycle of 60%) because dead times between transitions are inevitable in this mode of operation.

The high-pressure IFT interface used in conjunction with triple quadrupole MS instruments in pulsed MRM mode provides a 3-to-5-fold increase in platform sensitivity compared with the continuous mode that extends the linear response of the detector as a function of analyte concentration to the picomolar range. The IFT interface operating in pulsed MRM mode further enhances peak amplitudes by up to 10-fold compared to a single ion funnel (IF) interface in continuous mode. Pulsed MRM signals further exhibit up to a 2-to-3-fold reduced chemical background and a 4-to-8-fold improvement in the limit of detection (LOD). Enhancements in LOD provide reliable quantitation of proteins/peptides present at attomole levels (i.e., reflecting the absolute quantity of material loaded onto a column) in complex biological mixtures, as described further herein.

Performance of system 100 in pulsed MRM mode was rigorously evaluated and extensively characterized by spiking selected peptides and proteins into complex proteolytic digests of bacterial and mammalian proteomes and other complex biological matrices. Peptides were serially diluted (concentrations ranging from 0.25 nM to 500 nM) to prepare tryptic digests (0.25 mg/mL) of *Shewanella oneidensis* strain MR-1 proteins.

Each electrode in the IFT was energized with an RF waveform using a custom-built RF generator. Waveform on the adjacent plates was 180 phase-shifted, 60-70 V peak-to-peak in amplitude, and at a frequency of ~0.6 MHz. The DC gradient in the non-trapping sections of the IFT was maintained at 27 V/cm while the DC gradient in the trap section was kept at 4 V/cm to maximize trapping efficiency. Pulsed potentials were applied to an entrance and exit grids (95% transmission) to accumulate ions for a predetermined time. Ions were released from the trap in 500 μsec pulses that were synchronized with the second resolving quadrupole (Q3) scan.

Sample aliquots (5 μL) were loaded onto a LC column that was 15 cm×75-μm i.d fused-silica capillary (365-μm o.d., Polymicro Technologies, Phoenix, Ariz., USA), packed with 3-μm C18 packing material (300-Å pore size, Phenomenex, Terrence, Calif., USA). A constant pressure of 5000 psi was maintained during the 30 min gradient where mobile phase composition was varied exponentially from 0.1% formic acid in nano-pure water (mobile phase A) to 70% of 0.1% formic acid in ACN (mobile phase B). Electrospray-generated ions were sampled into the heated capillary-IFT interface and then introduced into the TSQ mass spectrometer (FIG. 1*a*). Ion source conditions and MS parameters were defined using instrument control software (e.g., Xcalibur 2.0.7, Thermo Fisher Scientific, San Jose, Calif., USA). Dwell times were in the range from 2 ms to 40 ms, and delays were between the ion release event and the Q3 scan. Since ions were accumulated in the IFT during each MRM and/or MS/MS analysis, dwell time was equivalent to accumulation time in the IFT. Switching time (or dead time in the continuous mode of operation) between transitions (FIG. 1*b*) for the TSQ instrument was measured to be equal to 4 ms.

FIG. 2 is a table listing exemplary peptides and associated fragments tested in conjunction with the testing of the present invention. Peptides (Sigma-Aldrich, St. Louis, Mo., USA) included, e.g., Kemptide (SEQ. ID. NO. 1); Angiotensin-I (SEQ. ID. NO. 2); Syntide-2 (SEQ. ID. NO. 3); Bradykinin (SEQ. ID. NO. 4); Dynorphin-A (Porcine1-13) (SEQ. ID. NO. 5); Leucine Enkephalin (SEQ. ID. NO. 6); Neurotensin (SEQ ID NO. 7); and Fibrinopeptide-A (SEQ ID NO. 8). Concentrations varied from 0.5 nM to 100 nM. Tandem MS/MS operation in conjunction with the IFT interface using pulsed (MRM) mode was compared against conventional MS/MS operation using a conventional single ion funnel interface in continuous mode.

Figure 3A:
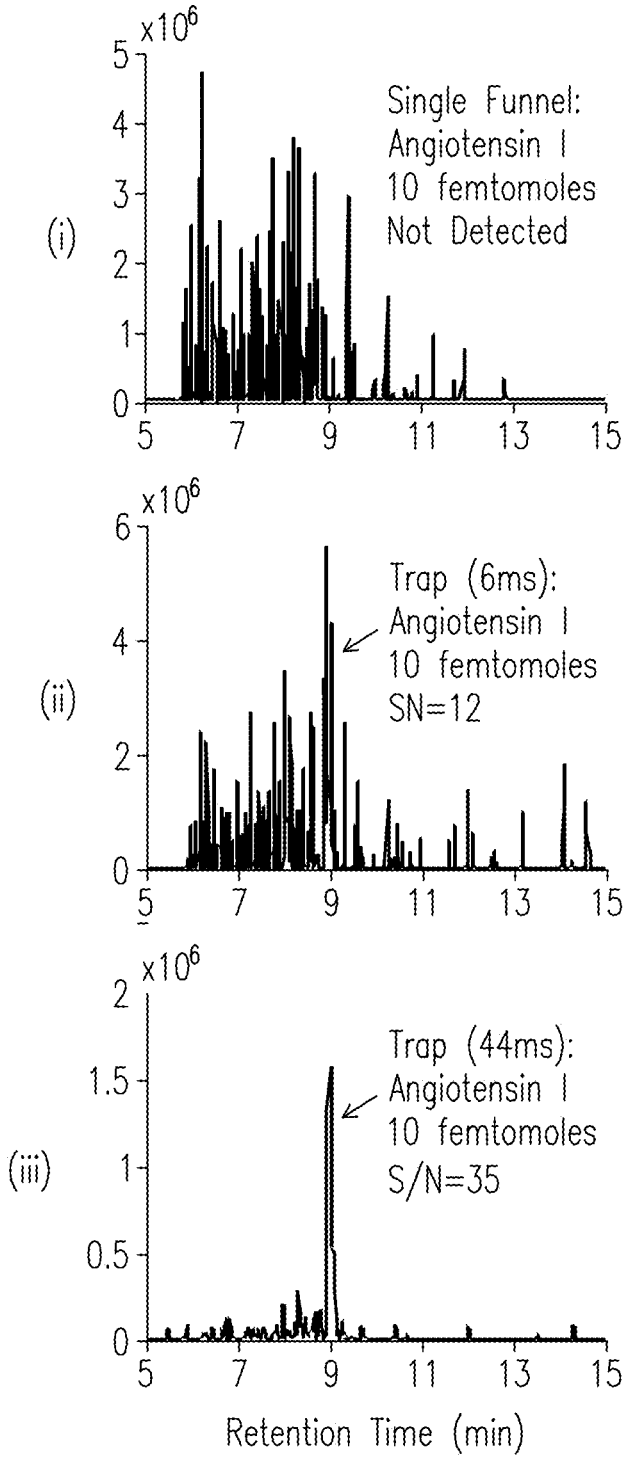
FIG. 3*a*-3*d* compare ion chromatograms from peptide transitions selected using a conventional ion funnel interface in continuous mode and an ion funnel trap (IFT) interface in pulsed MRM mode in accordance with the invention.
Figure 3B:
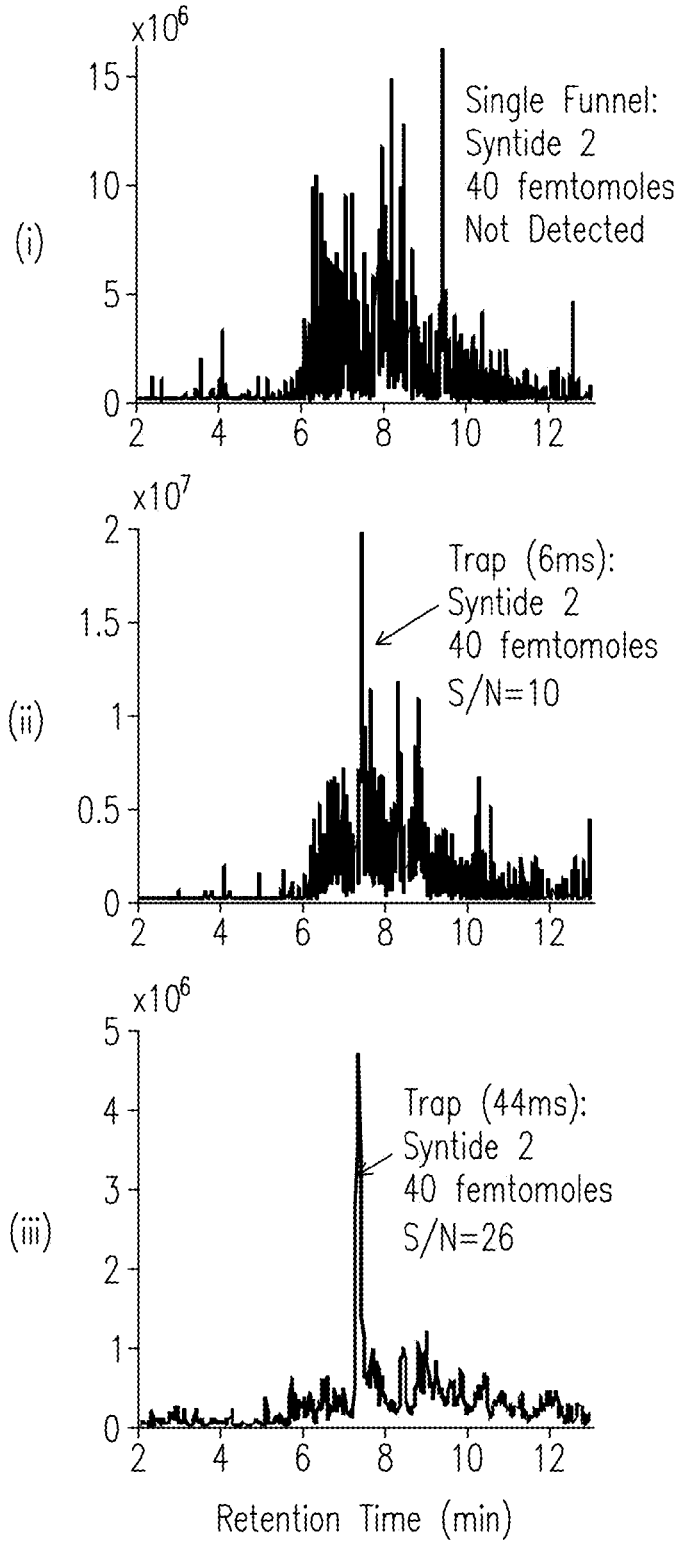

FIGS. 3*a*-3*d* compare selected ion chromatograms (SICs) resulting from analysis of transitions from four peptides (FIG. 2) that were spiked into a 0.25 mg/mL tryptic digests of *Shewanella oneidensis* proteome at concentrations ranging from 0.2 nM to 100 nM. Peptides were: Angiotensin I (SEQ. ID. NO. 2) (FIG. 3*a*); Syntide-2 (SEQ. ID. NO. 3) (FIG. 3*b*); Bradykinin (SEQ. ID. NO. 4) (FIG. 3*c*); and Neurotensin (SEQ ID NO. 7) (FIG. 3*d*), respectively. Peptides were analyzed using a conventional ion funnel interface in continuous mode (3(*a*)(*i*), 3(*b*)(*i*), 3(*c*)(*i*), 3(*d*)(*i*), and the ion funnel trap interface in pulsed MRM mode using accumulation times of 6 ms ((3(*a*)(*ii*), 3(*b*)(*ii*), 3(*c*)(*ii*), 3(*d*)(*ii*) and 44 ms (3(*a*)(*iii*), 3(*b*)(*iii*), 3(*c*)(*iii*), 3(*d*)(*iii*), respectively. MRM analyses were conducted with a total of 24 transitions using three most abundant transitions per precursor ion species. Each transition was monitored over an m/z range of ~2 mDa, with the averaging time varying from 2 ms to 40 ms. In FIG. 3*a*(*i*) and FIG. 3*b*(*i*), transitions for Angiotensin-I (SEQ. ID. NO. 2) (10 femtomoles) and Syntide-2 (SEQ. ID. NO. 3) (40 femtomoles) were not detectable (top graph) when analyzed using the conventional IF interface in continous mode due to presence of pronounced chemical background signals from matrix constituents. In contrast, using the IFT interface at an ion accumulation time of 6 msec, Angiotensin-I and Syntide 2 transitions were detectable at S/N values up to 12-fold. Increasing the ion accumulation time to 44 msec resulted in up to 10-fold signal loss across the SIC's, but was also accompanied by a pronounced reduction in the level of chemical background signal.

Figure 3C:
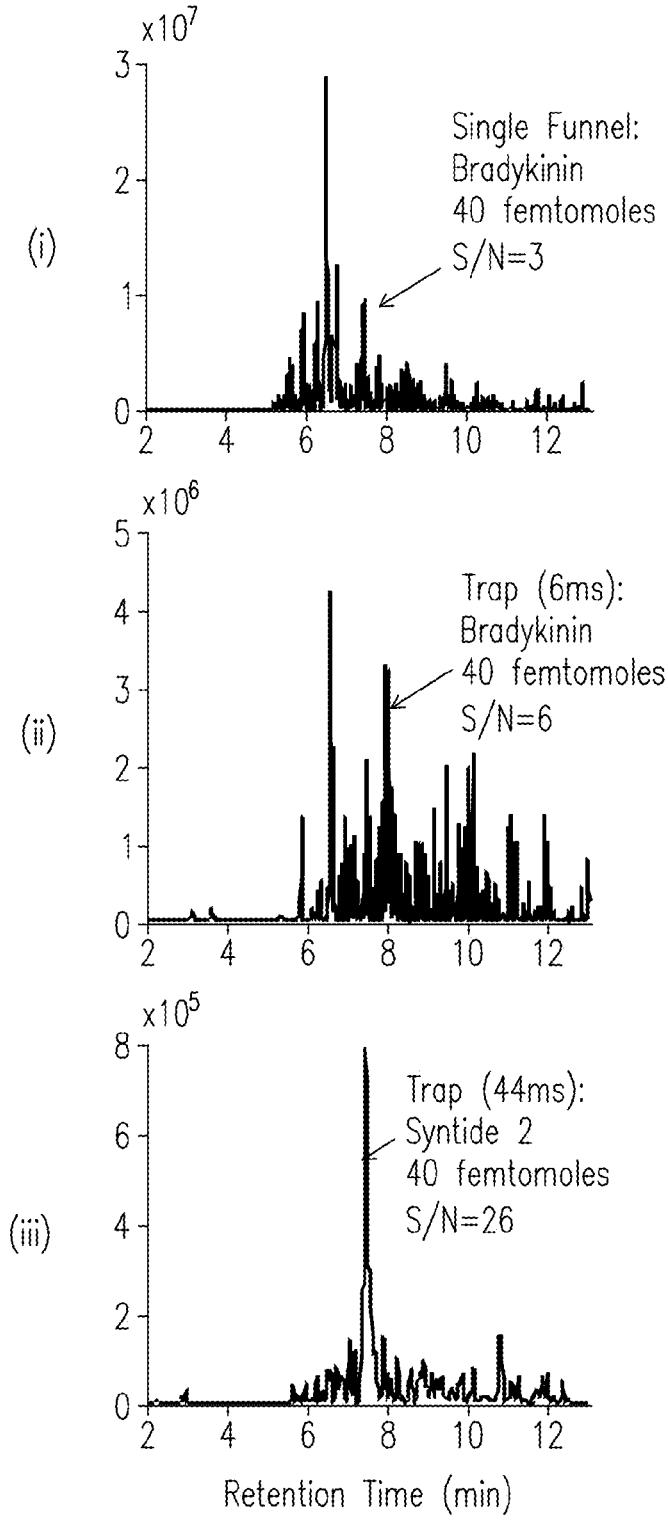
Figure 3D:
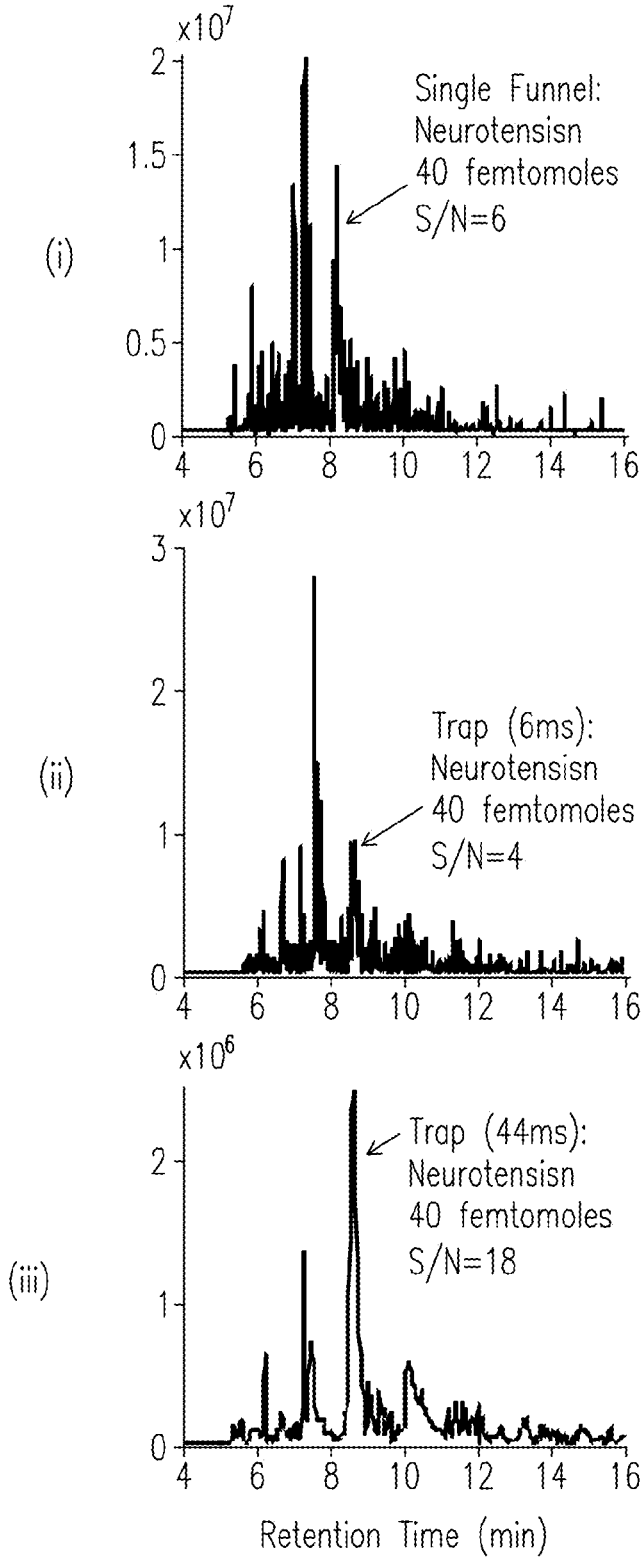

In FIG. 3*c* and FIG. 3*d*, transitions for Bradykinin (SEQ. ID. NO. 4) and Neurotensin (SEQ ID NO. 7) analyzed using the IF interface in continuous mode were detectable but exhibited peaks that were limited by pronounced signals from matrix constituents. Insignificant changes were observed for Bradykinin and Neurotensin peaks using the IFT interface at an ion accumulation time of 6 msec. However, overall, longer ion accumulation times in the IFT translated to from 6 to 30 fold enhanced S/N across all the studied analyte peaks when compared to the IF interface. Observed improvement in S/N ratios in pulsed MRM mode is attributed to efficient RF-heating in the IFT described previously herein at higher pressure (~1 torr), which contributes to efficient desolvation, solvent cluster break up, and evaporation that reduces the chemical background.

Figure 4A:
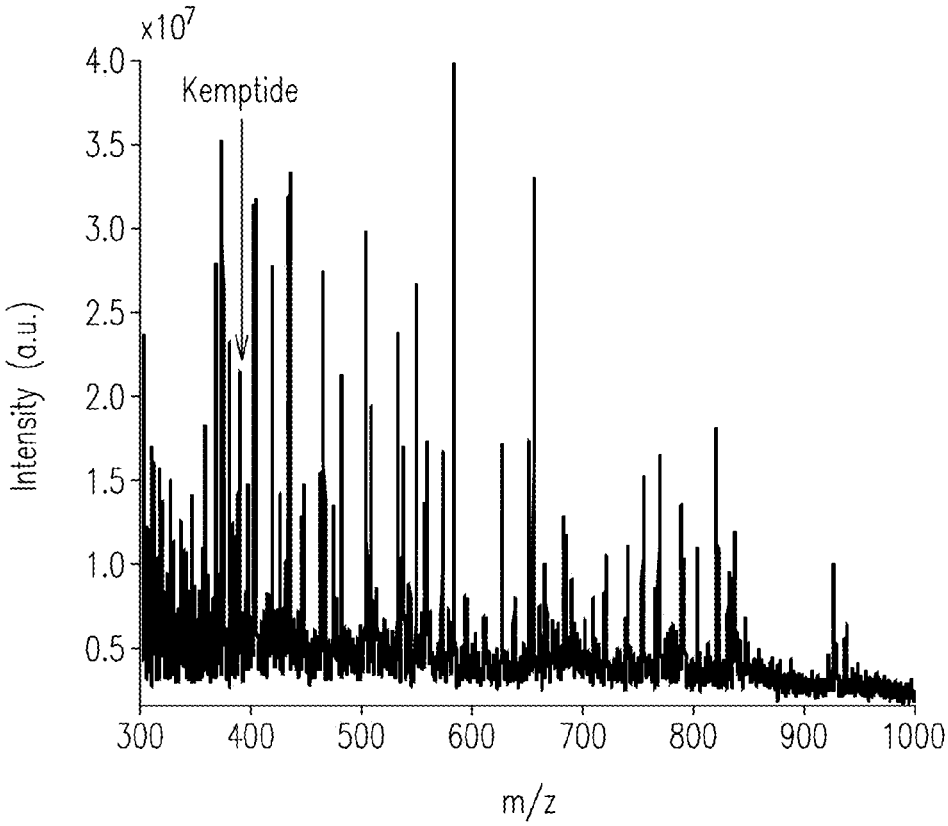
FIG. 4*a* is an MS spectrum of doubly charged Kemptide ion (SEQ. ID. NO. 1) selected following pulsed MRM analysis, according to an embodiment of the process of the invention.
Figures 4B, 4C:
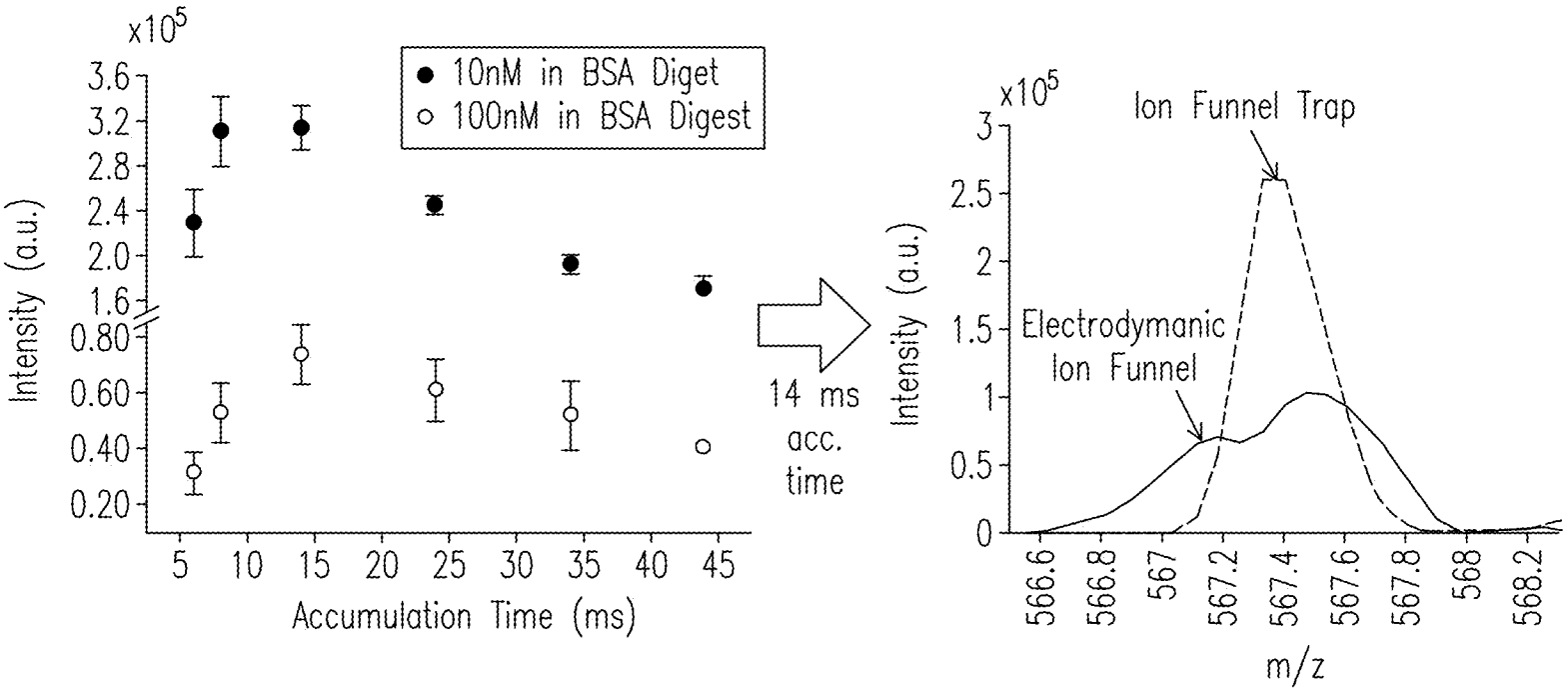
FIG. 4*b* shows the peak amplitude of Kemptide ion (SEQ. ID. NO. 1) as a function of accumulation time.
FIG. 4*c* compares MS spectra for Kemptide ion (SEQ. ID. NO. 1) acquired with a conventional ion funnel interface in continuous mode and an ion funnel trap (IFT) interface in pulsed MRM mode at an accumulation time of 14 ms.

Accumulation efficiencies of target analytes in the IFT in the presence of a complex matrix were evaluated by analyzing direct infusion experiments with a tryptic digest of bovine serum albumin (BSA) spiked with reference peptides. Peptides were added to a 160 nM BSA digest to produce two aliquots with peptide concentrations of 10 nM and 100 nM, respectively. FIG. 4*a* is a mass spectrum from a full Q1 scan obtained for the BSA tryptic digest spiked with 100 nM reference peptides. In the figure, matrix constituents dominate the mass spectrum. MS/MS analyses of reference peptides were also performed utilizing Q3 quadrupole In these experiments, IFT was filled with all ions without use of upstream ion filtering. Ion accumulation efficiency in the IFT ions was characterized in the presence of abundant matrix constituents. Results were compared for 24 transitions using the IF interface in continuous mode, and the IFT interface in pulsed MRM mode at accumulation times of 6 ms, 8 ms, 14 ms, 24 ms, 34 ms, and 44 ms, respectively. FIG. 4*b* plots intensity (MS peak amplitude) versus trap accumulation time for a single fragment ion of Kemptide (SEQ. ID. NO. 1) (m/z=567.33, $b_5$-$NH_3$) at 10 nM (○) and 100 nM (•) concentrations in a 160 nM BSA digest. Results show a 2.5-fold increase in peak amplitude at an optimum accumulation time of 8 ms (100 nM) and 14 ms (10 nM) when compared to the MS spectrum in which ions were not accumulated (IF). FIG. 4*c* is a mass spectrum for $b_5$-$NH_3$ (m/z=567.33) that compares signal gain results obtained using a conventional ion funnel interface with the ion funnel trap interface in MS/MS mode. In the figure, signal gain is consistent with results observed for samples containing a high concentration of target peptides. Two important conclusions can be drawn from these data. First, the maximum signal amplitude reached followed by a modest decrease in the amplitude of the reference peptides indicates that the IFT fills to capacity with matrix ions at longer accumulation times. Therefore, accumulation times for target peptides of interest are preferably in the range from about 10 msec to about 15 msec. Second, that a similar dependency of signal intensity on accumulation time for reference peptides is observed at different concentrations (10 nM and 100 nM) indicates that the observed decrease in amplitude at longer accumulation times is due to matrix ions rather than the reference peptides. As a result, the IFT-triple quadrupole instrument system 100 maintains linearity in signal response relative to spiked peptide concentrations even at accumulation times longer than trapping times deemed optimum, as described hereafter.

Figure 5A:
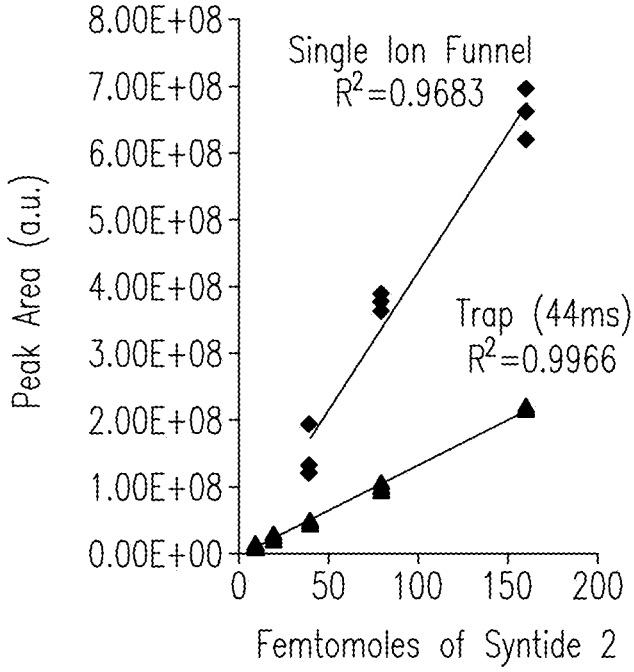
FIGS. 5*a*-5*b* compares regression analyses of peak area as a function of the quantity of Syntide 2 (SEQ. ID. NO. 3) loaded onto a LC column for a conventional ion funnel interface in continuous mode and an ion funnel trap interface in pulsed MRM mode.
Figure 5B:
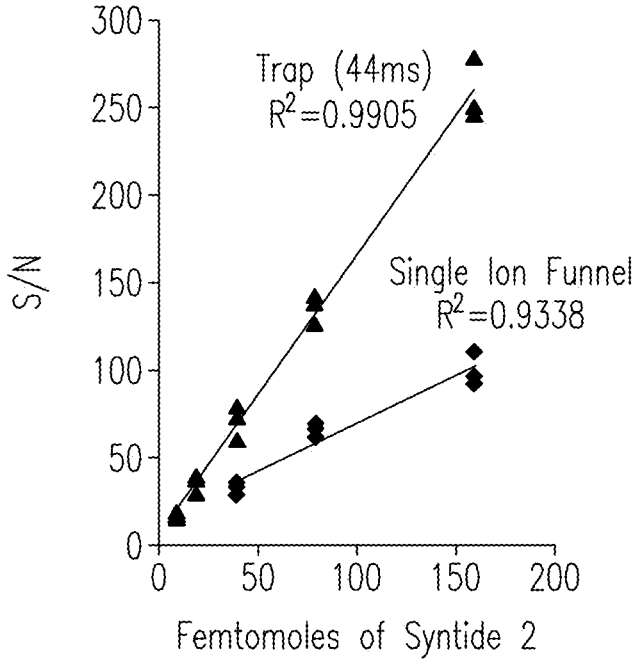

Linearity of analyte signal response to changes in analyte concentration is important for LC-MRM analyses. Analyte signal response as a function of analyte concentration was evaluated using a 0.25 mg/mL tryptic digest of *Shewanella oneidensis* spiked with eight reference peptides. Signal abundances of all the reference peptides were derived using a total of 24 transitions at different accumulation times. FIG. 5*a* compares regression analyses of ion signal peak area as a function of Syntide-2 (SEQ. ID. NO. 3) amount loaded onto the LC column for the ion funnel interface operating in continuous mode and the ion funnel trap interface operating in pulsed MRM mode, respectively. Data for continuous mode are shown in the concentration range between 40 and 160 femtomoles; no signals were detected at peptide amounts less than 40 femtomoles. For the IFT results, ion accumulation time was 44 msec. Here, data points represent the integrated signal for three Syntide-2 transitions recorded in separate LC experiments. Both LC-IF-MRM and LC-IFT-MRM experiments demonstrate excellent linearity between the peak areas and moles of Syntide-2 across the range of peptide concentrations. While the IF results display a steeper slope for the concentration curve, implying a higher signal intensity and presumably sensitivity, the IFT experiment yielded a lower limit of quantitation (LOQ) and LOD. FIG. 5*b* plots data from FIG. 5*a* using S/N as a function of the Syntide-2 concentration. Trends in FIG. 5*a* are reversed in favor of IFT results. Improvements in S/N for the IFT data with the pulsed MRM approach indicate that chemical backgrounds are significantly reduced, resulting in the increased sensitivity. The enhanced LOQ/LOD values are not limited to single peptides, but are observed for all analytes of interest, as shown hereafter. Despite the loss of some analyte signal at longer accumulation times, the S/N ratios of monitored peptides were found to further increase. This result implies that the limit of detection (LOD) in LC-MRM analyses can be improved for cases where quantitation is limited by chemical background.

Figures 6A, 6B, 6C:
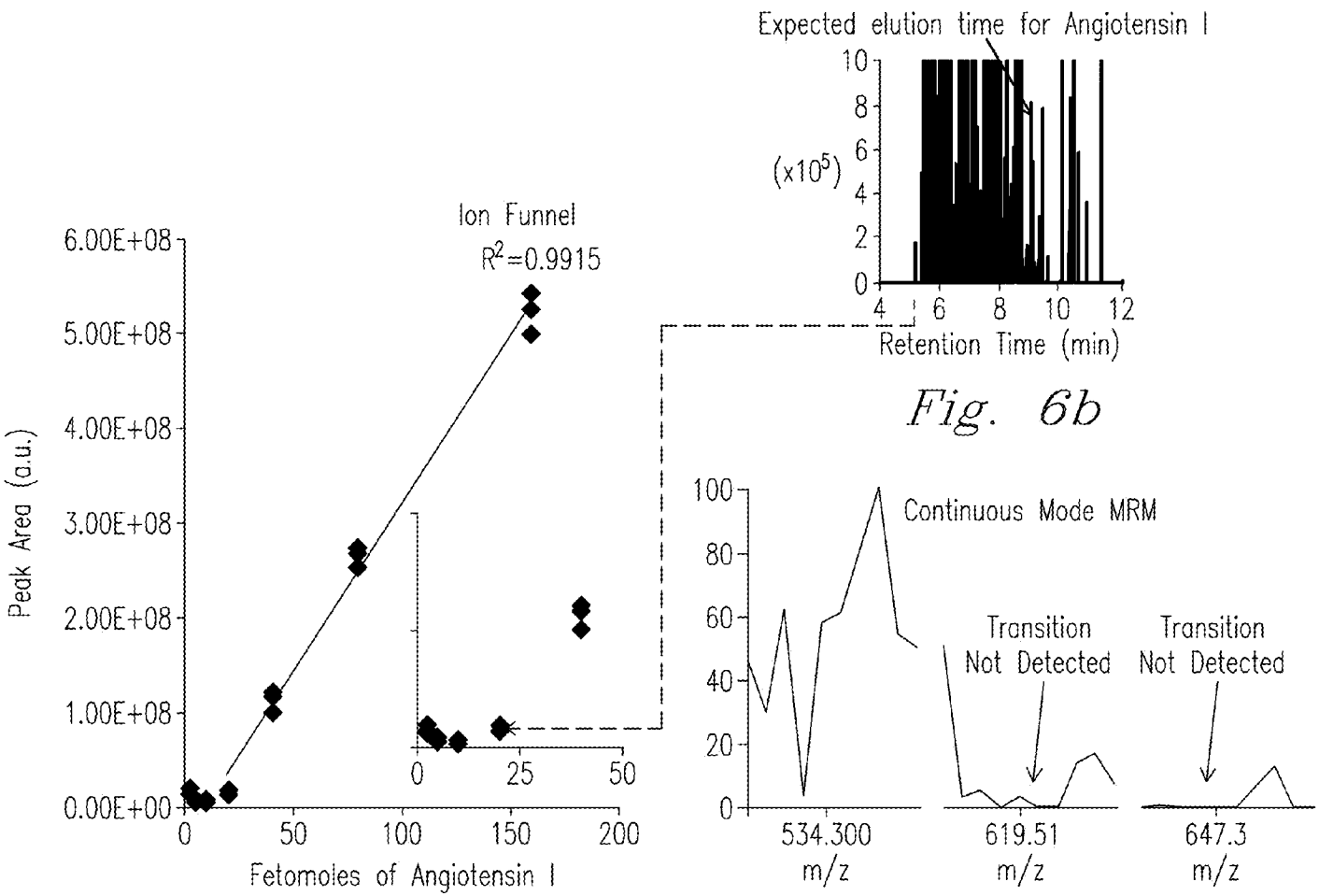
FIG. 6*a* plots peak area as a function of the quantity of Angiotensin-I (SEQ. ID. NO. 2) loaded onto a LC column in conventional continuous ion mode.
FIG. 6*b* shows a selected ion chromatogram for Angiotensin-I (SEQ. ID. NO. 2) in conventional continuous ion mode.
FIG. 6*c* is an MS spectrum in conventional continuous ion mode showing three transitions expected at the elution time for Angiotensin-I (SEQ. ID. NO. 2) in the selected ion chromatogram of FIG. 6*b*.

FIG. 6*a* is a plot showing peak area as a function of quantity of Angiotensin-I (SEQ. ID. NO. 2) loaded onto the LC column measured in continuous mode (LC-IF-MS). Peak areas correspond to signals summed for the three most abundant transitions. Each data point represents a separate LC-IF-MRM run. In the figure, IF experiment results show a Limit of Quantitation (LOQ) of 40 femtomoles (LOD). At quantities less than 40 femtomoles, correlation between the peptide signal and loaded peptide quantity is nonlinear, indicating the response at this level of spiked peptides arises from matrix constituents, not Angiotensin-I, as demonstrated hereafter. FIG. 6*b* shows a Selected Ion Chromatogram (SIC) for Angiotensin-I loaded at a quantity of 20 femtomoles. Results show the trace is dominated by background signals. FIG. 6*c* shows three transitions [i.e., (m/z 534.3), (m/z 619.51), and (m/z 647.3)] for ions that yielded the chromatographic peak at the expected elution time of Angiotensin-I (~9.0 min) in FIG. 6*b*. However, no MS signals were detected for ($a_5$) (m/z 619.51) and ($b_5$) (m/z 647.3) ions in conventional continuous mode.

Figures 7A, 7B, 7C:
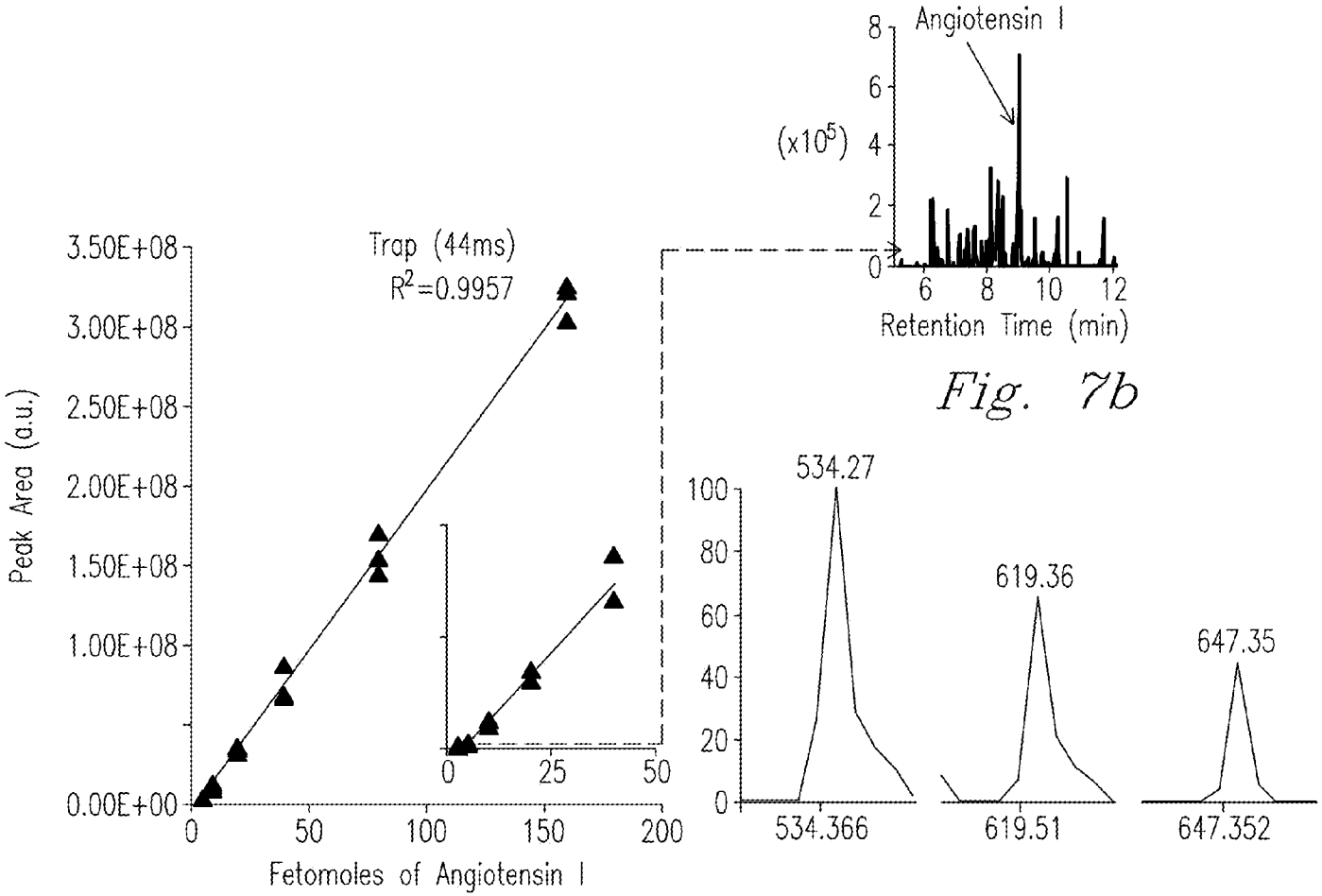
FIG. 7*a* plots peak area as a function of the quantity of Angiotensin-I (SEQ. ID. NO. 2) loaded onto a LC column in pulsed MRM mode.
FIG. 7*b* shows a selected ion chromatogram for Angiotensin-I (SEQ. ID. NO. 2) in pulsed MRM mode.
FIG. 7*c* is an MS spectrum in pulsed MRM mode showing three transitions expected at the elution time for Angiotensin-I (SEQ. ID. NO. 2) in the selected ion chromatogram of FIG. 7*b*.

FIG. 7*a* is a plot showing peak area as a function of quantity of Angiotensin-I loaded onto the LC column measured in pulsed mode (LC-IFT-MRM). In the figure, analysis repeated with the IFT interface demonstrates a linearity down to 2.5 femtomoles (LOD) ($r^2$=0.9957). In addition, the SIC in FIG. 7*b* shows a reduced chemical background and an intense Angiotensin-I response from the 5.0 femtomole data set at ~9 min, with a LOD that is improved by a factor of 8. In general, IFT results are characterized by a 5-to-10-fold improvement in the LOD compared to the continuous mode as a consequence of significantly reduced chemical background signals, despite the relative decrease in the analyte signal at higher concentrations. Also, increased ion statistics at the LOQ limit (compare FIG. 6*c* and FIG. 7*c*) in pulsed mode further improve the system linearity at low analyte concentrations. FIG. 7*c* shows three Angiotensin-I transitions: m/z 554.39 ($b_3$), m/z 619.51 ($a_5$) and m/z 647.3 ($b_5$), which yielded the Angiotensin-I chromatographic peak at 9.0 min in FIG. 7*b*.

These results demonstrate that a pulsed MRM approach in conjunction with an ion funnel trap (IFT) interface offers key analytical advantages. First, ion accumulation in the radio frequency (RF) ion trap at elevated pressures (>1 torr) improves desolvation of ionization source (e.g., ESI) droplets, which reduces chemical background ion noise at the detector and improves LOQ/LOD values. Second, in pulsed MRM mode, signal amplitude for selected transitions is enhanced due to an order-of-magnitude increase in ion packet charge density impinging on the detector per unit time, which enhances detector response at low ion statistics and improves linearity of the signal response as a function of the analyte concentration compared to continuous mode operation. Third, the LC-IFT-MRM instrument has a unity duty cycle in signal detection, as ion accumulation in the IFT eliminates dead times between transitions at any averaging time per analytical transition. This contrasts with continuous ion streams where dead times between transitions are inevitable. In addition, compared with the continuous mode of operation, pulsed MRM signals yield up to a 10-fold enhanced peak amplitude and a 2-to-3 fold reduced chemical background, that improves the limit of detection (LOD) by a factor of ~4 to ~8. And, signal response as a function of analyte concentrations for all peptides under investigation show excellent linearity over a wide range of analyte concentrations. The pulsed MRM approach of the invention is a viable tool for quantitative analysis of trace analytes in highly complex biological matrices.

While preferred embodiments of the present invention have been shown and described, it will be apparent to those of ordinary skill in the art that many changes and modifications may be made with various material combinations without departing from the invention in its true scope and broader aspects. The appended claims are therefore intended to cover all such changes and modifications as fall within the spirit and scope of the invention.

SEQUENCE LISTING

<160> NUMBER OF SEQ ID NOS: 8

<210> SEQ ID NO 1
<211> LENGTH: 7
<212> TYPE: PRT
<213> ORGANISM: artificial
<220> FEATURE:
<223> OTHER INFORMATION: Synthetic Heptapeptide for Protein Kinase
Binding

<400> SEQUENCE: 1

Leu Arg Arg Ala Ser Leu Gly
1 5

<210> SEQ ID NO 2
<211> LENGTH: 10
<212> TYPE: PRT
<213> ORGANISM: Homo sapiens

<400> SEQUENCE: 2

Asp Arg Val Tyr Ile His Pro Phe His Leu
1 5 10

<210> SEQ ID NO 3
<211> LENGTH: 14
<212> TYPE: PRT
<213> ORGANISM: Homo sapiens

<400> SEQUENCE: 3

Pro Leu Ala Arg Thr Leu Ser Val Ala Gly Leu Pro Lys Lys
1 5 10

<210> SEQ ID NO 4
<211> LENGTH: 9
<212> TYPE: PRT
<213> ORGANISM: Homo sapiens

<400> SEQUENCE: 4

Arg Pro Pro Gly Phe Ser Pro Phe Arg
1 5

<210> SEQ ID NO 5
<211> LENGTH: 13
<212> TYPE: PRT
<213> ORGANISM: Porcine

<400> SEQUENCE: 5

Tyr Gly Gly Phe Leu Arg Arg Ile Arg Pro Lys Leu Lys
1 5 10

<210> SEQ ID NO 6
<211> LENGTH: 5
<212> TYPE: PRT
<213> ORGANISM: Homo sapiens

<400> SEQUENCE: 6

Tyr Gly Gly Phe Leu
1 5

<210> SEQ ID NO 7
<211> LENGTH: 13
<212> TYPE: PRT
<213> ORGANISM: Homo sapiens

<400> SEQUENCE: 7

-continued

```
Glu Leu Tyr Glu Asn Lys Pro Arg Arg Pro Tyr Ile Leu
1               5                   10


<210> SEQ ID NO 8
<211> LENGTH: 16
<212> TYPE: PRT
<213> ORGANISM: Homo sapiens

<400> SEQUENCE: 8

Ala Asp Ser Gly Glu Gly Asp Phe Leu Ala Glu Gly Gly Gly Val Arg
1               5                   10                  15
```

What is claimed is:

1. A pulsed multiple reaction monitoring method characterized by the steps of:

accumulating preselected precursor ions in a trapping device at a pressure of at least about 1 Torr to compress same therein; and transmitting the accumulated precursor ions from the trapping device as a compressed ion packet into a quadrupole that is synchronized with the onset of an ion scan within the quadrupole.

2. The method of claim 1, further including the steps of:

transmitting the accumulated precursor ions in the compressed ion packet through a first resolving quadrupole to select precursor ions therein; and collisionally activating the selected precursor ions in a collision cell to generate fragment ion transitions for same therein.

3. The method of claim 2, further including transmitting selected fragment ion transitions as compressed ion packets through a second resolving quadrupole for analysis therein.

4. The method of claim 1, wherein the accumulating and transmitting steps are interspersed between continuous ion flow.

5. The method of claim 1, wherein the accumulating step utilizes a radio trapping device operating in a range between about m/z 50 to about m/z 10,000.

6. The method of claim 1, wherein the accumulation step is performed in a time of from about 2 milliseconds to about 50 milliseconds.

7. The method of claim 1, wherein the step of transmitting accumulated precursor ions includes using a trigger (release) pulse tied with a release time from about 100 μsec to about 500 μsec.

8. The method of claim 1, wherein the accumulated packet of preselected precursor ions is in a narrow mass range selected from about 1 mDa to about 2 mDa.

9. The method of claim 1, wherein the transmitting step includes transmitting at a range defined by a mass-to-charge (m/z) ratio of less than 1 Da.

10. The method of claim 1, wherein the quadrupole is a second resolving quadrupole and the ion scan employs a scan width of about 2 mDa and a scan time of less than 10 msec.

11. The method of claim 1, wherein the rate of ion packet transmission is determined by DC-potentials applied to electrodes of the trapping portion of the trapping device and pulsed potentials applied to an entrance grid and a trapping grid that introduce and release ions from the trapping device, respectively.

12. The method of claim 1, wherein the quadrupole is a second resolving quadrupole and the transmitting includes transmitting a single fragment ion (ion transition) as an ion packet while synchronizing release to coincide with the onset of the ion scan in the second resolving quadrupole.

13. A pulsed multiple reaction monitoring method, comprising the steps of:

accumulating preselected precursor ions in a trapping device at a pressure of at least about 1 Torr to form a compressed ion packet therein; and transmitting the compressed ion packet from the trapping device into a quadrupole that is synchronized with the onset of the ion scan in the quadrupole;

wherein the synchronization employs a delay time with a duration equal to the sum of the dead time between ion transitions and a half width of the ion scan time in the quadrupole.

* * * * *